US012269079B2

(12) United States Patent
Sasaki et al.

(10) Patent No.: US 12,269,079 B2
(45) Date of Patent: Apr. 8, 2025

(54) ROLLING MILL FOR DIAMETER REDUCING ROLLING AND METHOD FOR MANUFACTURING STRIP MATERIAL

(71) Applicant: JFE STEEL CORPORATION, Tokyo (JP)

(72) Inventors: Shunsuke Sasaki, Tokyo (JP); Tatsuro Katsumura, Tokyo (JP); Hiroki Ota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 279 days.

(21) Appl. No.: 17/775,952

(22) PCT Filed: Sep. 29, 2020

(86) PCT No.: PCT/JP2020/037006

§ 371 (c)(1),
(2) Date: May 11, 2022

(87) PCT Pub. No.: WO2021/100327

PCT Pub. Date: May 27, 2021

(65) Prior Publication Data

US 2022/0388048 A1 Dec. 8, 2022

(30) Foreign Application Priority Data

Nov. 22, 2019 (JP) ..... 2019-211784

(51) Int. Cl.
*B21B 1/16* (2006.01)
*B21B 19/02* (2006.01)
(Continued)

(52) U.S. Cl.
CPC ..... *B21B 1/16* (2013.01); *B21B 19/02* (2013.01); *B21B 19/10* (2013.01); *B21B 27/021* (2013.01)

(58) Field of Classification Search
CPC ..... B21B 19/04; B21B 19/06; B21B 19/02; B21B 19/10
See application file for complete search history.

(56) References Cited

U.S. PATENT DOCUMENTS 1,957,916 A * 5/1934 Stiefel ..... B21B 19/02 72/97
4,416,134 A 11/1983 Hayashi
2017/0001225 A1 1/2017 Hayashi

FOREIGN PATENT DOCUMENTS

JP S56-154201 A 11/1981
JP S56154201 * 11/1981 ..... B21B 1/16
(Continued)

OTHER PUBLICATIONS

Translation of JPS56154201.*
(Continued)

*Primary Examiner* — Bobby Yeonjin Kim
(74) *Attorney, Agent, or Firm* — Oliff PLC

(57) ABSTRACT

A rolling mill includes three or more rolling rolls aligned along a circumferential direction and arranged so each rotary shaft is skewed with respect to a pass line of a material to be rolled, wherein the material to be rolled made of a pipe or bar material passes between the rolling rolls while being rotated to undergo diameter reducing rolling. At least one rolling roll selected from the three or more rolling rolls is smaller in roll diameter than at least one other rolling roll. When at least one rolling roll having a relatively maximum roll diameter defined as a maximum diameter rolling roll and at least one rolling roll smaller in roll diameter than the maximum is defined as a small diameter rolling roll, the small diameter rolling roll has a roll diameter equal to or less than 90% of the roll diameter of the maximum diameter rolling roll.

20 Claims, 7 Drawing Sheets

(51) Int. Cl.
*B21B 19/10* (2006.01)
*B21B 27/02* (2006.01)

(56) References Cited

FOREIGN PATENT DOCUMENTS

| | | | |
|---|---|---|---|
| JP | S57-137009 | A | 8/1982 |
| JP | S61-253102 | A | 11/1986 |
| JP | S63-202402 | U | 12/1988 |
| JP | H04-135004 | A | 5/1992 |
| JP | H07-155806 | A | 6/1995 |
| JP | 2004-154851 | A | 6/2004 |
| JP | 4506563 | B2 | 7/2010 |
| JP | 5858206 | B1 | 2/2016 |

OTHER PUBLICATIONS

May 17, 2022 International Preliminary Report on Patentability issued in International Patent Application No. PCT/JP2020/037006.
Nov. 17, 2020 International Search Report issued in International Patent Application No. PCT/JP2020/037006.
Nov. 21, 2022 Search Report issued in European Patent Application No. 20890864.0.

* cited by examiner

ROLLING MILL FOR DIAMETER REDUCING ROLLING AND METHOD FOR MANUFACTURING STRIP MATERIAL

TECHNICAL FIELD

The present invention relates to a technology for performing diameter reducing rolling on an outer diameter of a strip material made of a pipe or bar material having a circular cross-sectional shape. The present invention relates to a technology capable of manufacturing a pipe or bar material excellent in outer diameter dimensional accuracy even when the material is made small in diameter by diameter reduction by rolling.

Note that a rolling method according to the present invention is a rolling method different from piercing rolling. The rolling technology of the present invention is a rolling technology for reducing the diameter of a material to be rolled, for example, a steel pipe produced by piercing rolling, electric resistance welded pipe manufacturing process, or the like, with excellent outer diameter dimensional accuracy.

BACKGROUND ART

In the present specification, a method for rolling by arranging rotary shafts of rolling rolls so as to be skewed with respect to a pass line of a material to be rolled is referred to as skew rolling.

The skew rolling is used in perforation rolling (piercing rolling) and outer diameter reducing rolling. The skew rolling uses a rolling mill in which a plurality of rolls are arranged along a circumferential direction of a material to be rolled, and a rotary shaft of each rolling roll is arranged so as to be skewed with respect to a pass center (the pass line). Then, in the skew rolling, the material to be rolled made of a pipe or bar material is fed between the rolls being rotated, and pulled in and caused to pass through between the rolls while being rotated by the rotation of the rolls. In the case of diameter reducing rolling, the material to be rolled is caused to pass through between rolls smaller than the outer diameter of the material to be rolled, thereby performing diameter reducing rolling for reducing the outer diameter of the material to be rolled. In the case of piercing rolling, arranging a plug between the rolls allows piercing rolling of a bar material.

Examples of the skew rolling mill for piercing rolling include technologies disclosed in PTLs 1 to 3.

PTL 1 discloses a skew rolling device that exhibits excellent piercing rollability on a material poor in workability by adopting a cone shape as the roll shape, as well as arranging rolling rolls at a crossing angle β with respect to a pass line and using four rolling rolls.

In addition, PTL 2 discloses a method for significantly reducing the thickness of a cold metal pipe by using a skew rolling mill using two or three rolls.

Furthermore, PTL 3 discloses a rolling mill including two rolling rolls arranged facing each other and a guide roll arranged between the rolling rolls, in which the guide roll that is not a rolling roll is provided with a backup roll.

On the other hand, PTL 4 discloses a method for improving an uneven thickness that occurs in a pipe when performing diameter reducing rolling for reducing an outer diameter of the pipe by skew rolling using three or four rolling rolls.

CITATION LIST

Patent Literature

PTL 1: JP Pat. No. 5858206
PTL 2: JP Pat. No. 4506563
PTL 3: JPS 63-202402 U
PTL 4: JPS 57-137009 A

SUMMARY OF INVENTION

Technical Problem

Technologies disclosed in PTL 1 to PTL 3 are those relating to piercing rolling. However, PTL 1 to PTL 3 do not describe application to outer diameter reducing rolling.

Note that PTL 3 discloses the backup mechanism. However, in PTL 3, the backup mechanism is provided on the guide roll that is not a rolling roll, and there is no description of arrangement of a backup roll for a rolling roll that receives heavy load. Moreover, PTL 3 does not consider interference between rolling rolls when three or more rolling rolls receiving heavy load are arranged.

Additionally, PTL 4 also discloses a technology for performing outer diameter reducing rolling on a pipe material by skew rolling. However, in PTL 4, the three or more rolling rolls arranged along a circumferential direction are all the same in diameter. Therefore, in the technology disclosed in PTL 4, there is less freedom of choice regarding the outer diameter dimension of the material to be rolled after rolling because of an interference relationship between adjacent rolling rolls.

Here, in outer diameter reducing rolling, three or more rolling rolls are more advantageous than two in terms of improving outer diameter dimensional accuracy. In other words, using three or more rolling rolls is advantageous for suppression of damage and improvement of uneven thickness. However, when arranging three or more rolling rolls along the circumferential direction, a roll interval can be narrowed down only to a range in which there is no interference between the rolling rolls, so that there is a restriction on reduction in the outer diameter of a material to be rolled that can be produced. Additionally, when the outer diameters of all the rolling rolls to be used are reduced to roll a small diameter material to be rolled, a roll shaft of each rolling roll deflects under rolling load, which reduces outer diameter dimensional accuracy.

The present invention has been made in view of the above problems, and it is an object of the invention to enable materials to be rolled ranging from large to small in diameter to undergo outer diameter reducing rolling with high outer diameter dimensional accuracy.

Solution to Problem

The present inventors conducted intensive and extensive studies and consequently found that, in a skew rolling mill using three or more rolling rollers, a range of rollable minimum outer diameters of a material to be rolled can be significantly expanded by setting a roll diameter of at least one rolling roll selected from rolling rolls to equal to or less than 90% of a roll diameter of at least one other rolling roll. The inventors also found that when only the roll diameter of at least one of the rolling rolls is reduced, roll shaft deflection under rolling load is suppressed as compared to when the roll diameters of all the rolling rolls are reduced, so that high outer diameter dimensional accuracy can be maintained over the entire length.

The present invention has been made based on the above-described findings.

Specifically, a rolling mill for diameter reducing rolling according to an aspect of the present invention is a rolling mill including three or more rolling rolls aligned in a circumferential direction of a material to be rolled made of a pipe or bar material, and arranged such that each rotary shaft of the rolling rolls is skewed with respect to a pass line of the material to be rolled, at least one rolling roll selected from the three or more rolling rolls being configured as a drive roll that is rotationally driven, and the material to be rolled being caused to pass through between the three or more rolling rolls while being rotated to undergo the diameter reducing rolling, in which at least one rolling roll selected from the three or more rolling rolls is smaller in roll diameter than at least one other rolling roll, and in which when, among the three or more rolling rolls, at least one rolling roll having a maximum roll diameter is defined as a maximum diameter rolling roll and at least one rolling roll smaller in diameter than the maximum diameter rolling roll is defined as a small diameter rolling roll, the small diameter rolling roll has a roll diameter equal to or less than 90% of the roll diameter of the maximum diameter rolling roll.

Additionally, a method for manufacturing a strip material according to another aspect of the present invention comprises rolling a material to be rolled made of a pipe or bar material by using the above-described rolling mill for diameter reducing rolling to reduce an outer diameter of the material to be rolled.

Advantageous Effects of Invention

According to the aspects of the present invention, materials to be rolled ranging from large to small in diameter can undergo diameter reducing rolling with excellent outer diameter dimensional accuracy. In other words, according to the aspects of the present invention, the diameter reducing rolling of a material to be rolled (a strip material) made of a pipe or bar material using the skew rolling mill enables excellent outer diameter dimensional accuracy to be easily obtained over the entire length of the material to be rolled while expanding an outer diameter control range.

BRIEF DESCRIPTION OF DRAWINGS

FIG. 13 is a diagram illustrating examples of a backup mechanism, in which

DESCRIPTION OF EMBODIMENTS

Hereinafter, embodiments of the present invention will be described with reference to the drawings.

Here, the drawings are schematic, and relationships between thicknesses and planar dimensions of respective components, a ratio between the respective components, and the like are different from actual ones. Additionally, the following embodiments exemplify structures for embodying the technological idea of the present invention, and the technological idea of the invention is not to be construed as limiting shapes, structures, and the like of the components to those below. The technological idea of the invention may be modified in various ways within the technological scope defined by the appended claims.

The following description will exemplify a steel pipe that is an example of a pipe material as a material to be rolled 1 made of a strip material. The material to be rolled 1 that undergoes diameter reducing rolling may be a bar material.

(Structure)

Figure 1A:
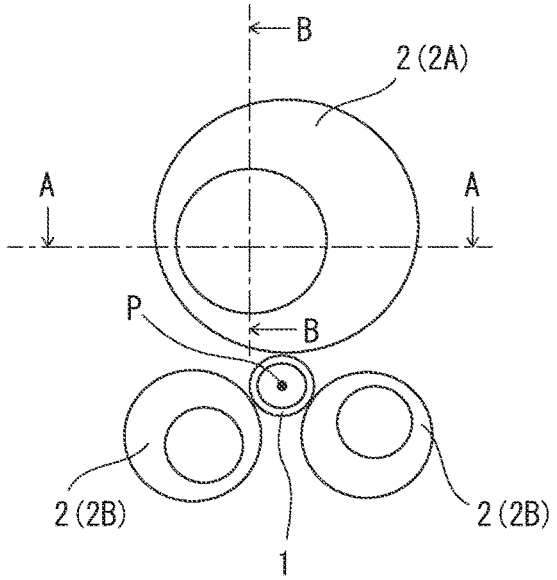
FIG. 1 is a schematic diagram illustrating examples of arrangement of three rolling rolls in a skew rolling mill according to an embodiment of the present invention.
Figure 1B:
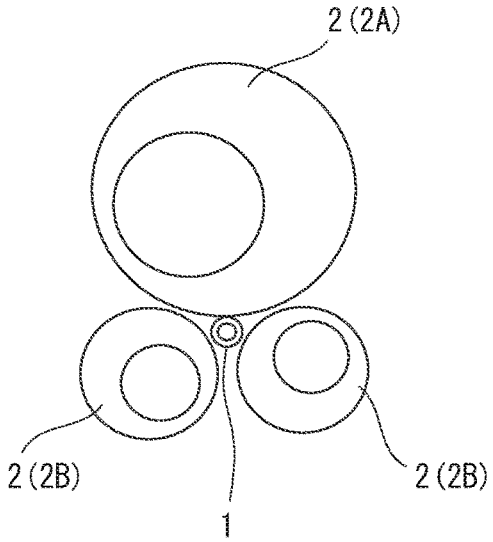
Figure 2:
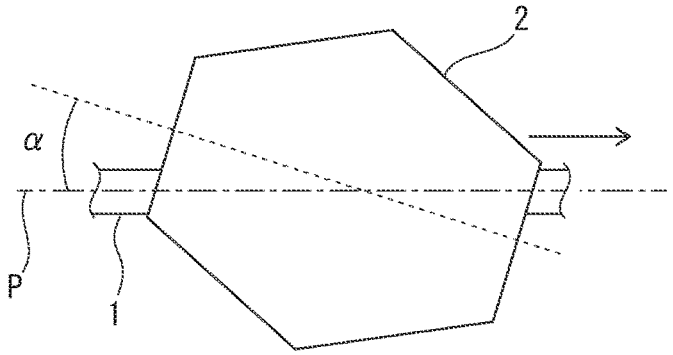
FIG. 2 is a cross-sectional diagram taken along line A-A of FIG. 1.
Figure 3:
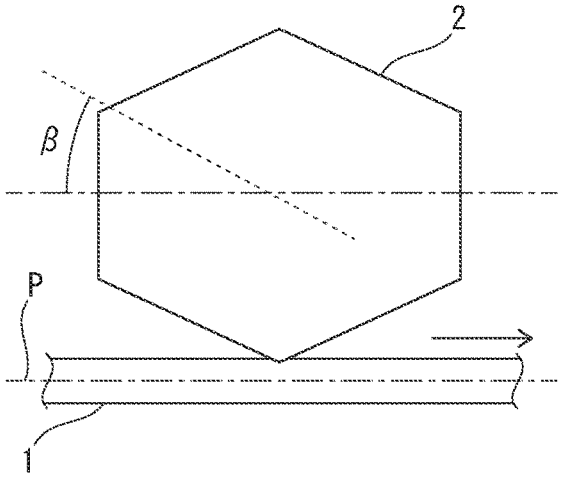
FIG. 3 is a cross-sectional diagram taken along line B-B of FIG. 1.

In the present embodiment, a rolling mill for diameter reducing rolling that adopts skew rolling (hereinafter also referred to simply as rolling mill) includes three rolling rolls 2, as illustrated in FIG. 1. The number of the rolling rolls 2 may be four or more. The three rolling rolls 2 are arranged along a circumferential direction around a pass line P of the material to be rolled 1. As illustrated in FIGS. 2 and 3, a rotary shaft of each rolling roll 2 is given a skew angle $\alpha$ or a crossing angle $\beta$ with respect to the pass line P, whereby the each rolling roll 2 is arranged so as to be skewed along the pass line P. FIG. 3 illustrates a case where the crossing angle $\beta$ is zero degrees.

Additionally, at least one rolling roll 2 selected from the three rolling rolls 2 is configured as a drive roll that is to be rotationally driven. Then, as illustrated in FIGS. 2 and 3, the rolling mill is configured such that the rotary shaft of each rolling roll 2 is arranged so as to be skewed with respect to the pass line P, whereby a steel pipe 1 that comes in contact with the rolling rolls 2 is pulled in between the three rolling rolls 2 while being rotated, and caused to pass through between the rolling rolls 2 to undergo diameter reducing rolling. As a basic structure of the skew rolling mill thus formed, a known structure may be adopted.

<Roll Diameter>

Additionally, in the rolling mill of the present embodiment, at least one rolling roll 2 selected from the three rolling rolls 2 is smaller in roll diameter than at least one other rolling roll 2.

In the present specification, among the plurality of rolling rolls 2, at least one rolling roll 2 having a maximum roll diameter is defined as a maximum diameter rolling roll 2A, and at least one rolling roll 2 smaller in roll diameter than the maximum diameter rolling roll 2A is defined as a small diameter rolling roll 2B. While FIG. 1 illustrates one maximum diameter rolling roll 2A, two or more maximum diameter rolling rolls 2A may be provided. In addition, when the small diameter rolling roll 2B includes a plurality of rolling rolls 2, each of the small diameter rolling rolls 2B may be different in roll diameter. When the plurality of small diameter rolling rolls 2B have different roll diameters, the three or more rolling rolls 2 may be arranged asymmetrically with respect to the pass line P.

Then, in the rolling mill of the present embodiment, the roll diameter of the small diameter rolling roll 2B is equal to or less than 90% of the roll diameter of the maximum diameter rolling roll 2A. Preferably, the roll diameter of the small diameter rolling roll 2B is equal to or more than 50% of the roll diameter of the maximum diameter rolling roll 2A.

In the present specification, the roll diameters are compared between maximum diameters of each rolling roll.

Here, interference between the rolling rolls is most problematic at a maximum outer diameter portion that is a portion having a maximum diameter in a roll axis direction. Therefore, in the present specification, the roll diameters of the rolling rolls refer to roll diameters at the maximum outer diameter portions of the rolling rolls 2.

Figure 4A:
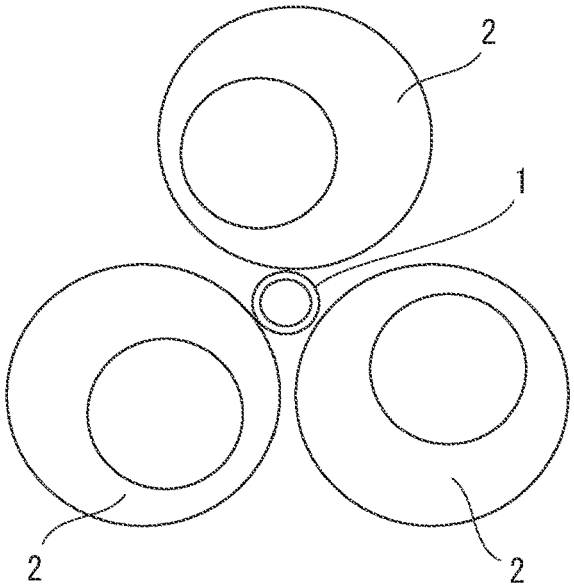
FIG. 4 is a schematic diagram illustrating examples of arrangement of three rolling rolls in a Comparative Example.
Figure 4B:
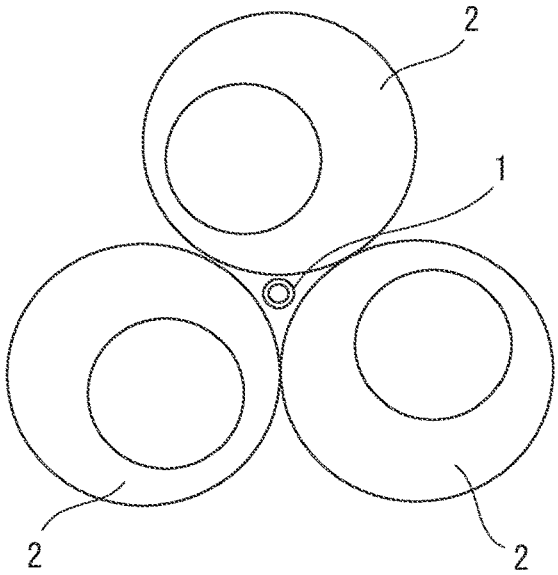

As in FIG. 1, in the present embodiment, the roll diameter of the maximum diameter rolling roll 2A is not changed, and the roll diameter of the small diameter rolling roll 2B is made smaller than that of the maximum diameter rolling roll 2A. By doing this, the present embodiment enables diameter reducing rolling to be performed in a wide dimensional range, from large diameter steel pipes to small diameter steel pipes. On the other hand, when the three rolls 2 have the same diameter, the steel pipe 1 having a large diameter does not cause interference between the rolling rolls, as in FIG. 4A, whereas the steel pipe 1 having a small diameter causes interference between the rolling rolls, as in FIG. 4B. Due to this, in the case of the three rolls having the same diameter, the range of steel pipe diameters that can be manufactured is narrowed.

However, as in the present embodiment, setting the roll diameter of the small diameter rolling roll 2B to equal to or less than 90% of the roll diameter of the maximum diameter rolling roll 2A enables even steel pipes 1 having smaller diameters to undergo outer diameter rolling while maintaining high dimensional accuracy.

Next, a description will be given of the reason that the roll diameter of the small diameter rolling roll 2B is set to equal to or less than 90% of the roll diameter of the maximum diameter rolling roll 2A.

Figure 5:
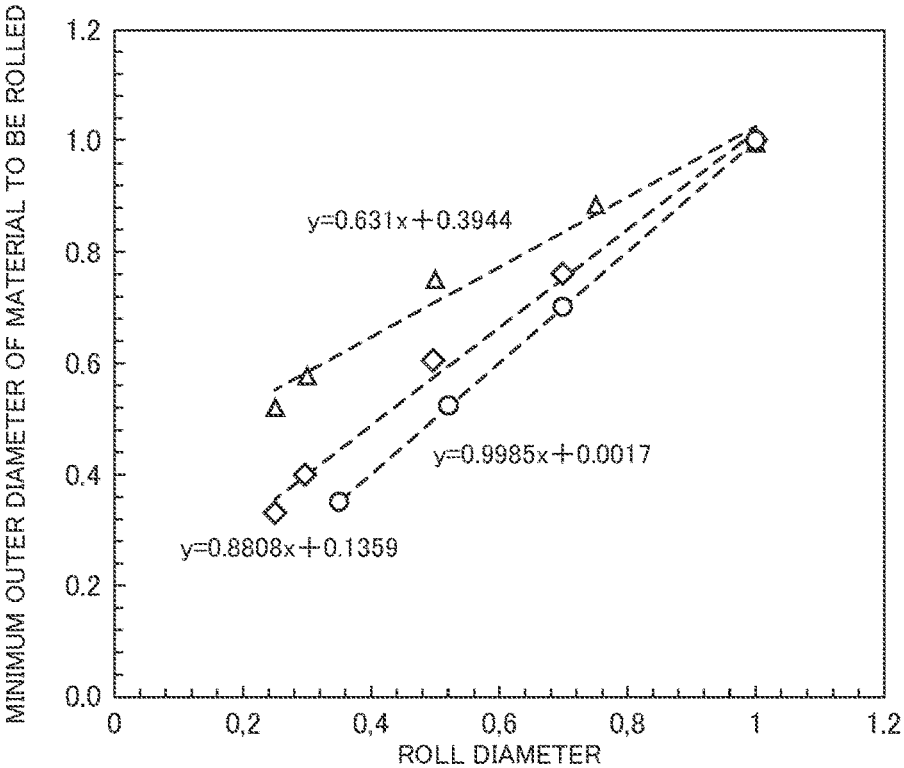
FIG. 5 is a diagram illustrating a relationship between a roll diameter and a minimum outer diameter of a material to be rolled.

FIG. 5 is a diagram illustrating a relationship between a roll diameter and a minimum outer diameter of the material to be rolled in skew rolling using three rolling rolls 2. The minimum outer diameter of the material to be rolled refers to a rollable minimum outer diameter of the material to be rolled 1. In FIG. 5, the vertical axis represents the minimum outer diameter of the material to be rolled, and the horizontal axis represents a maximum roll diameter that allows for obtaining the minimum outer diameter. Additionally, in FIG. 5, the roll diameter and the rollable minimum outer diameter are dimensionless. Then, the rollable minimum outer diameter of the material to be rolled 1 when the roll diameter is 1 is represented as 1.

In FIG. 5, symbol "o" represents a case where the roll diameters of the three rolling rolls 2 were all the same (Comparative Example). The Comparative Example indicates that when a minimum outer diameter of the material to be rolled that can be manufactured with a roll diameter (1.0) is 1.0 and if it is desired to be manufactured with a diameter of 0.8 times the above diameter, the maximum roll diameter also needs to be reduced to 0.8.

In FIG. 5, symbol "Δ" represents a case where two maximum diameter rolling rolls 2A and one small diameter rolling roll 2B were used. Then, the roll diameter of the small diameter rolling roll 2B was relatively changed to 25% with respect to the roll diameter of the maximum diameter rolling rolls 2A.

In FIG. 5, symbol "◇" represents a case where one maximum diameter rolling roll 2A and two small diameter rolling rolls 2B were used. Then, the roll diameter of the small diameter rolling rolls 2B were relatively changed with respect to the roll diameter of the maximum diameter rolling roll 2A.

As can be seen from FIG. 5, every time the roll diameter of one small diameter rolling roll 2B is reduced by 10% with respect to the roll diameter of the maximum diameter rolling roll 2A, the range that allows for manufacturing of the minimum outer diameter of the material to be rolled can be expanded by 6.3%. In other words, this case indicates that a steel pipe having a smaller diameter can be rolled. It is also found that when the roll diameter of the two small diameter rolling rolls 2B is reduced with respect to the roll diameter of the maximum diameter rolling roll 2A, every time the roll diameter of the small diameter rolling rolls 2B is reduced by 10%, the range of the minimum outer diameter of the material to be rolled that can be manufactured is expanded by 8.8%.

As described above, when all the three rolling rolls 2 are made small, the rollable minimum outer diameter of the material to be rolled 1 becomes smaller by the same rate as reduction in the roll diameter. However, on the other hand, when all the three rolling rolls 2 are made small, rigidity of all the rolling rolls 2 is lowered. Due to this, when rolling a material that requires high rolling load and torque for processing, all the rolling rolls 2 deflect, so that dimensional accuracy is significantly reduced. Alternatively, problems arise such as that due to shortage of the diameter of a drive shaft that transmits torque, the rolling rolls cannot rotate.

On the other hand, as can be seen in FIG. 5, according to the present invention, even when the roll diameter of one or two rolling rolls 2 among the three rolling rolls 2 is made small, the rollable minimum outer diameter of the material to be rolled 1 can be made small. Then, FIG. 5 indicates that by setting the roll diameter of the small diameter rolling roll 2B to equal to or less than 90% of the roll diameter of the maximum diameter rolling roll 2A, interference between the rolling rolls can be suppressed, and also the rollable minimum outer diameter of the material to be rolled 1 can be reduced by 5% or more. Furthermore, in the present embodiment according to the present invention, unlike when all the rolling roll diameters are equally made small, at least one rolling roll 2 (the maximum diameter rolling roll 2A) can be maintained with high rigidity. Thus, in the present embodiment, excellent dimensional accuracy is obtained, as well as the roll shaft of the maximum diameter rolling roll 2A can be made large, so that large torque can be applied, as a result of which torque insufficient in the small diameter rolling roll 2B small in roll diameter can be compensated.

In this way, setting the roll diameter of the small diameter rolling roll 2B is set to equal to or less than 90% of the roll diameter of the maximum diameter rolling roll 2A enables the rollable minimum outer diameter of the material to be rolled 1 to be made small with a significant difference while suppressing reduction in dimensional accuracy.

It is unnecessary to particularly limit a lower limit value of the roll diameter ratio. However, when the roll diameter of the small diameter rolling roll 2B is too small, there is a risk of breakage loss of the rolling roll, and the like. Accordingly, the lower limit value of the roll diameter ratio is preferably 50% or more. When the roll diameter ratio is furthermore from 65% to less than 85%, it is more preferable because a wide range of manufacturability can be obtained while suppressing breakage loss of the small diameter rolling roll 2B.

Here, the roll diameter ratio is expressed by ((roll diameter of small diameter rolling roll 2B)/(roll diameter of maximum diameter rolling roll 2A))×100[%].

<Number of Rolling Rolls 2>

The plurality of rolling rolls 2 are aligned along the circumferential direction of the pass line P to form a rolling space having a smaller diameter than the diameter of the steel pipe 1 before rolling. The number of the rolling rolls 2 is preferably three or more in which interference between the rolling rolls becomes problematic. Note that while there is no limit to an upper limit of the number of the rolling rolls 2, equipment complexity increases as the number of the rolling rolls increases. Therefore, the number of the rolling rolls 2 is preferably four or less.

<Rolling Roll Shape>

The shape of each rolling roll 2 can be either a barrel shape or a cone shape used in ordinary skew rolling. Additionally, in the present embodiment, even a roll shape whose roll surface profile is asymmetric can be effective. In other words, the present embodiment can be used as long as the structure of skew rolling is satisfied in which the rolling rolls 2 are arranged in the circumferential direction of the pass line in such a manner as to skew the rotary shafts of the rolling rolls 2 with respect to a pass center (the pass line), a material to be rolled made of a pipe or bar material is fed between the rolls being rotated, and is pulled in and caused to pass through between the rolls while being rotated by the rotation of the rolls. Thus, there is no limit to the rolling roll shape.

<Material to Be Rolled 1>

The present embodiment exemplifies the steel pipe 1 produced by piercing rolling, an electric resistance welded pipe manufacturing process, or the like as the material to be rolled 1. The strip material made of a pipe or bar material that undergoes outer diameter reduction is not limited to being made of steel. The material, processing temperature, and the like of the material to be rolled 1 are not limited as long as it is a strip material that enables the effect of outer diameter reduction to be obtained by skew rolling by plastic deformation, for example, a strip material made of a metal material.

The present embodiment is adaptable to various outer diameters of materials to be rolled, and can provide high finished dimensional accuracy by withstanding high rolling load. Thus, use of the present embodiment in cold rolling of a high strength material such as, for example, steel, is particularly significantly effective. The present embodiment is suitable for such a cold rolling.

Furthermore, when using the present embodiment in cold rolling of a steel pipe material having high strength, such as steel, high dimensional accuracy and excellent mechanical characteristics can be obtained. The excellent mechanical characteristics mean that a tensile yield strength in a pipe axis direction is 757.9 MPa or more. Additionally, the excellent mechanical characteristics mean that a yield strength ratio expressed by, for example, (compressive yield strength in pipe axis direction/tensile yield strength in pipe axis direction) is from 0.90 to 1.15. Here, in cold drawing and cold pilger rolling, which are ordinary cold working methods for steel pipes, high dimensional accuracy can be obtained, but a yield strength ratio of 0.90 or more cannot be obtained due to a Bauschinger effect in the pipe axis direction. Therefore, when excellent mechanical characteristics are required, it is preferable to use cold rolling using the embodiment of the present invention. Among steels, in the case of a steel in which an austenite phase low in yield strength is contained in an amount of 20% or more in a structure thereof, it is difficult to obtain the above ratio between the compressive yield strength in the pipe axis direction and the tensile yield strength in the pipe axis direction. However, in the present embodiment, the excellent mechanical characteristics can also be obtained by using strain that is applied to obtain high dimensional accuracy. Note that, to more stably achieve both dimensional accuracy and the mechanical characteristics, a ratio of a steel pipe outer diameter after rolling to a steel pipe outer diameter before rolling is preferably 95% or less.

Furthermore, to obtain high strength, the ratio is preferably 90% or less.

<Rolling Conditions>

Usual rolling conditions used in skew rolling, i.e., a roll distance between the rolling rolls and the number of rotation of the rolling rolls can be freely selected.

Additionally, the plurality of rolling rolls 2 are arranged in the circumferential direction with respect to the pass line P through which the material to be rolled 1 passes. In this case, it is preferable to arrange the rolling roll shaft of each rolling roll 2 at an angle of ((360 degrees/the number of rolls) ±20 degrees) in the circumferential direction of the pass line P.

As described in the related art literature, when the rolling roll diameters are all the same, the rolling rolls 2 are arranged at an equal angle in the circumferential direction of the pass line P.

However, the present embodiment uses the rolling roll 2 having a different roll diameter as a part of the plurality of rolling rolls 2. Therefore, the present embodiment adopts an arrangement that is not symmetrical (asymmetry) with respect to the pass line in accordance with the number and diameter of the rolling rolls 2 to be used. In other words, in the present embodiment, to minimize interference between adjacent rolling rolls, the arrangement (arrangement angle) of the rolling rolls 2 along the circumferential direction is not performed at equal intervals. Additionally, in that case, a roll moving direction at the time of changing an interval between the rolling rolls is not on a parabola around the pass line P but is a direction in accordance with the number and diameter of the rolling rolls 2. The arrangement of the rolling rolls 2 and the roll moving direction may be selected appropriately according to the diameter and number of the rolls to be used. Regarding a combination of roll diameters and moving amounts of the rolls, the arrangement and moving direction where the interference between the adjacent rolls is the smallest can be geometrically uniquely determined. However, as the asymmetry is stronger, a housing shape storing the rolling rolls 2 will be more complicated. Due to this, in the present embodiment, each of the rolling roll shafts arranged in the circumferential direction with respect to the pass line P through which the material to be rolled 1 passes is arranged at an angle in a range of (360 degrees/the number of rolls) ±20 degrees.

The interval of the arrangement angle indicates the arrangement angle of each roll in the circumferential direction of the material to be rolled at a roll shaft center position. When equally allocating the arrangement angle interval, for example, in the case of three rolls, the arrangement angle interval between the rolls is 120 degrees obtained by trisecting 360 degrees, and, in the case of four rolls, the arrangement angle interval of each roll is 90 degrees. The method disclosed in PTL 1 uniquely determines the arrangement angle interval by using the number of the rolling rolls.

On the other hand, in the present embodiment according to the present invention, for example, the arrangement angle intervals between the rotary shafts of the rolling rolls arranged in the circumferential direction of the pass line P are set so as to be different from one another, whereby the arrangement angle interval between the rotary shafts of each rolling roll is set to each appropriate one. This enables provision of high outer diameter accuracy in a small diameter pipe or bar material.

<Drive Roll>

Figure 6A:
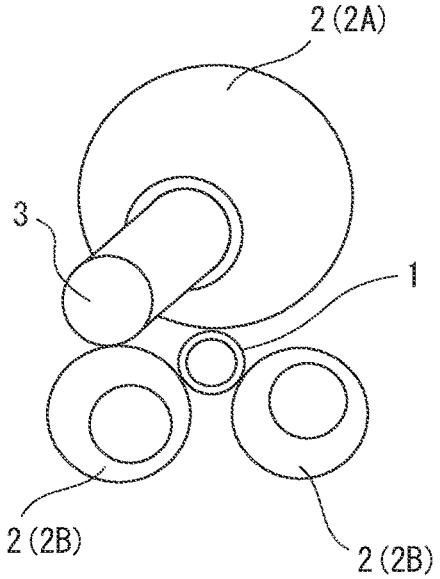
FIG. 6 is a diagram illustrating a relationship between a drive roll and a non-drive roll.
Figure 6B:
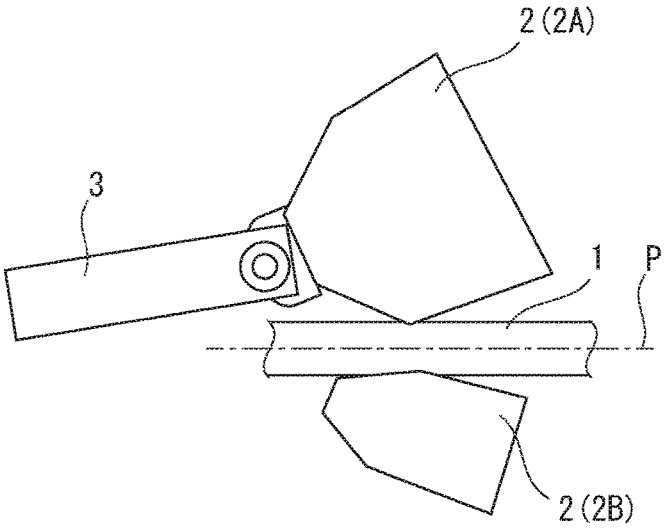

In the present embodiment, as illustrated in FIG. 6, at least one rolling roll 2 selected from the maximum diameter rolling roll 2A is set as a drive roll. Additionally, at least one rolling roll 2 selected from at least the small diameter rolling roll 2B is preferably set as a non-drive rolling roll. Reference sign 3 denotes a drive shaft 3.

Since the maximum diameter rolling roll 2A can be maintained with the large roll diameter, sufficient torque can be transmitted. Thus, the maximum diameter rolling roll 2A is preferably used as the drive roll. With the structure such that drive torque is transmitted to the maximum diameter rolling roll 2A, it is possible to compensate for a lack of torque due to the smaller shaft diameter in the small diameter rolling roll 2B. In addition, in a case where rolling can be sufficiently performed with the torque of the maximum diameter rolling roll 2A, axial bending of the steel pipe 1 (the material to be rolled 1) can be effectively suppressed by removing a restraint around the rotary shaft of the small diameter rolling roll 2B. In other words, when the three or more rolling rolls 2 for use in skew rolling have mutually different roll diameters, it is necessary to match each roll peripheral speed with a peripheral speed of the material to be rolled 1. If the balance collapses, a force in a traveling direction that the material to be rolled 1 receives from a roll contact surface varies in each rolling roll 2, which accordingly causes axial bending. On the other hand, by removing the restraint in the rotational direction of the small diameter rolling roll 2B to subordinate the rotation of the small diameter rolling roll 2B to the rotation of the material to be rolled 1, there is consequently obtained a balance with a force in the traveling direction applied by other rolling roll(s) 2, so that occurrence of bending can be suppressed.

Figure 7A:
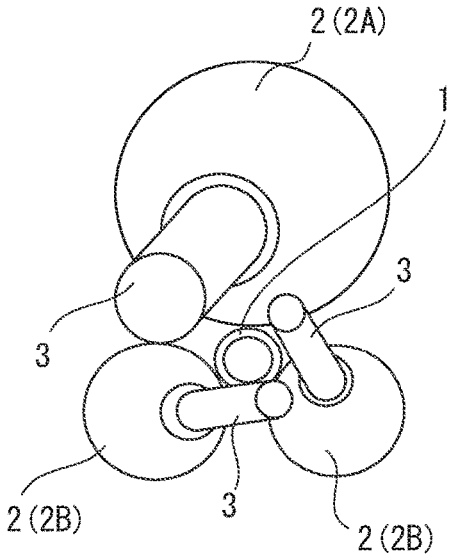
FIG. 7 is a diagram illustrating a case where all rolling rolls are drive rolls.
Figure 7B:
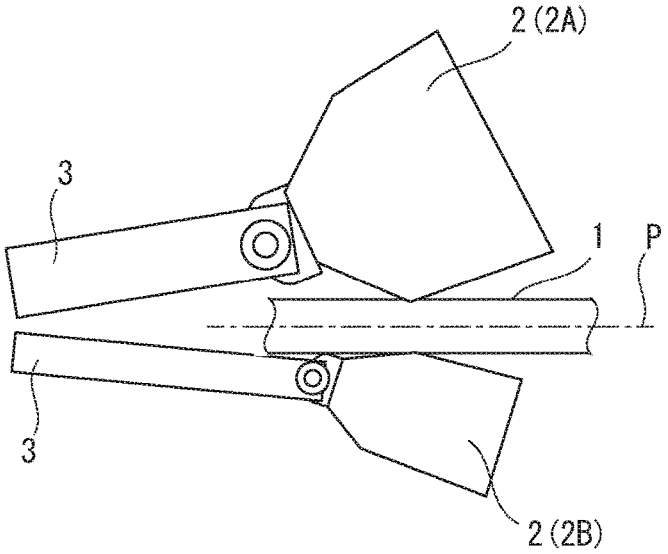
Figure 8A:
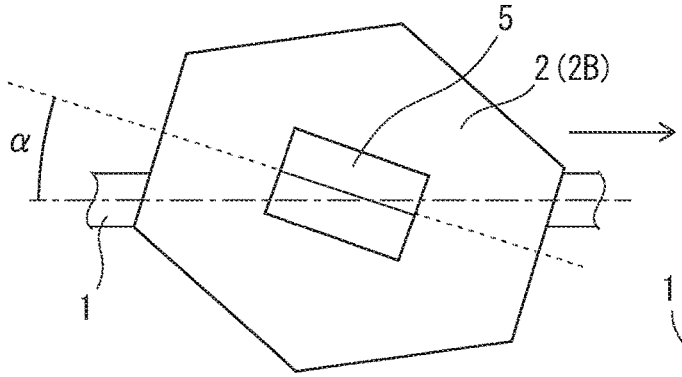
FIG. 8 is a diagram illustrating an example of a roll-shaped backup mechanism.
Figure 8B:
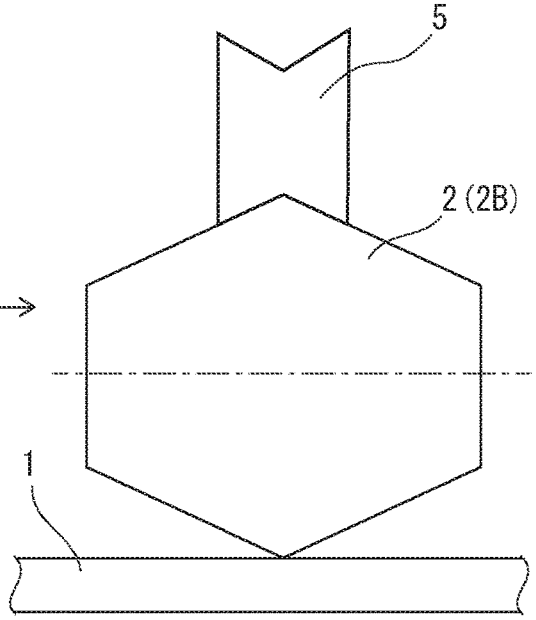
Figure 9A:
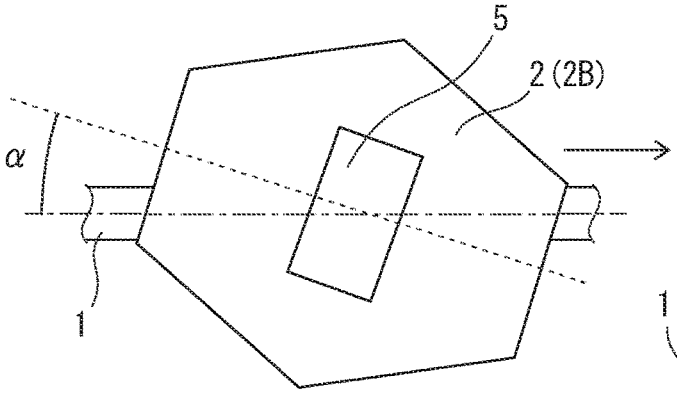
FIG. 9 is a diagram illustrating an example of a planar backup mechanism.
Figure 9B:
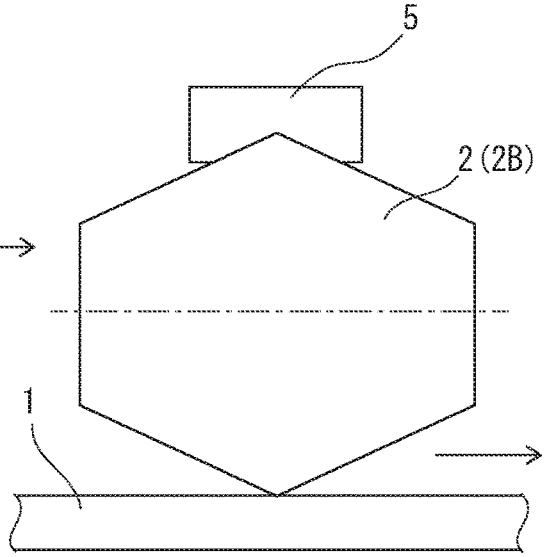
Figure 10A:
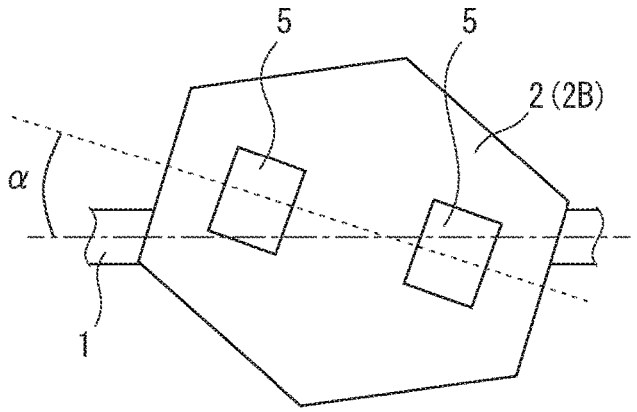
FIG. 10 is a diagram illustrating an example in which two roll-shaped backup mechanisms are arranged in a longitudinal direction.
Figure 10B:
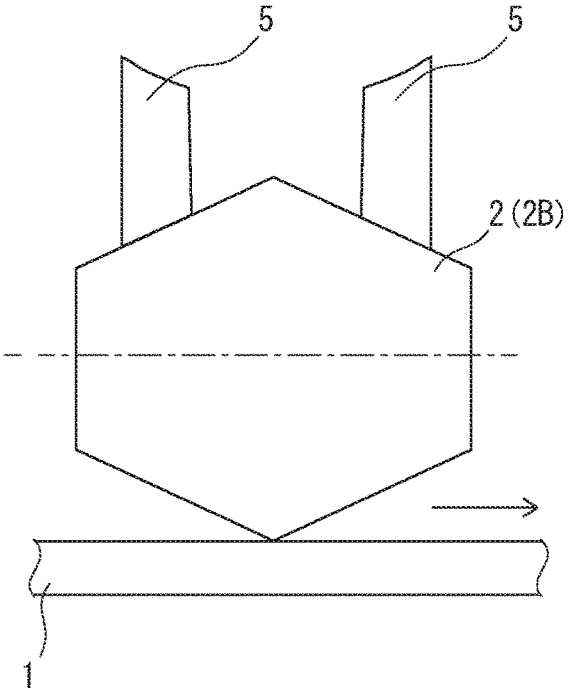
Figure 11A:
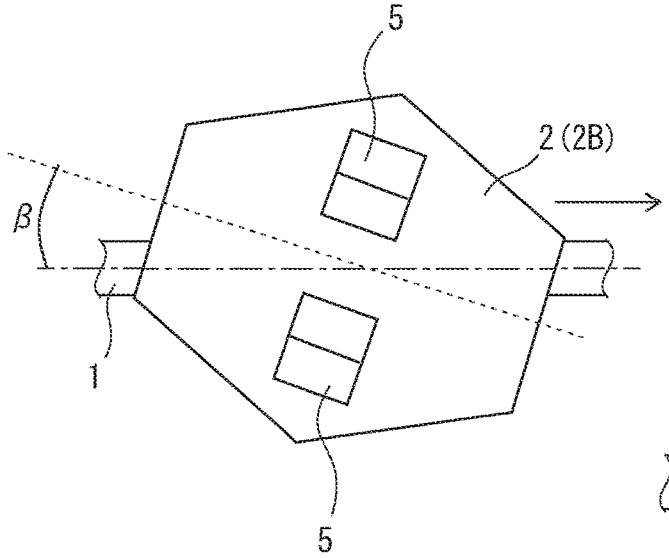
FIG. 11 is a diagram illustrating an example in which two roll-shaped backup mechanisms are arranged in a roll circumferential direction.
Figure 11B:
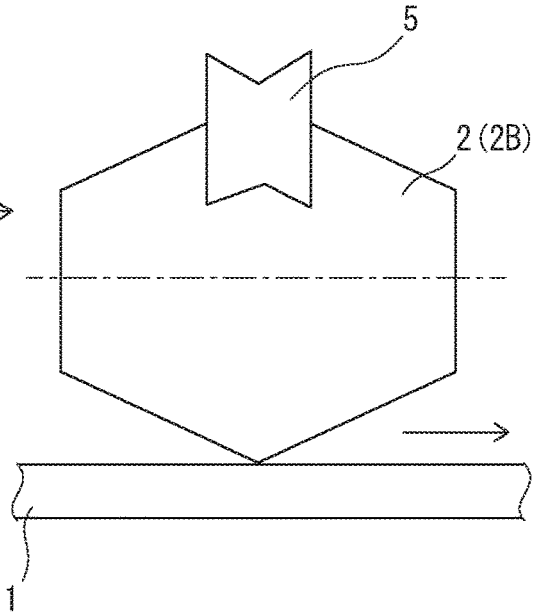
Figure 12:
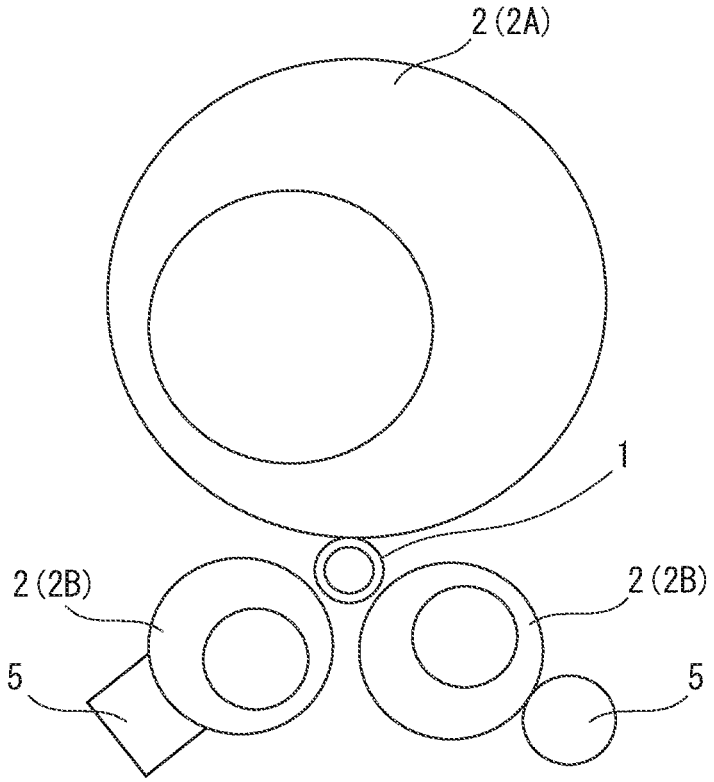
FIG. 12 is a diagram illustrating an example in which a plurality of small diameter rolling rolls are provided with a backup mechanism.
Figure 13A:
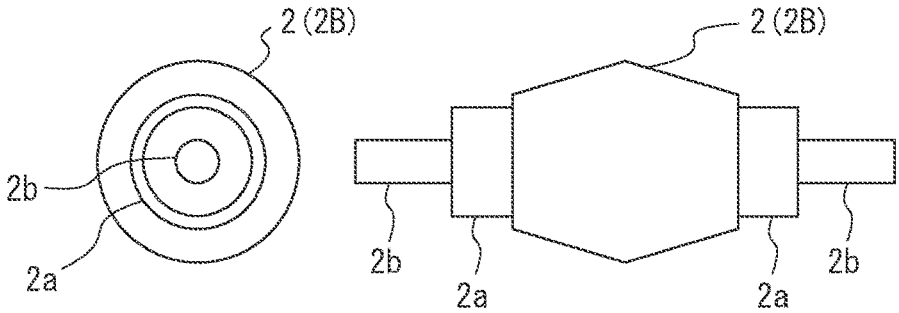
FIG. 13A illustrates a roll shape.
Figure 13B:
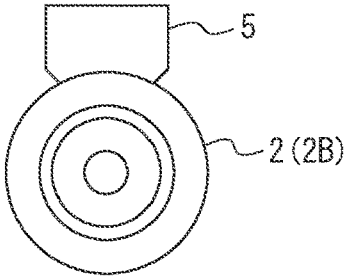
FIGS. 13B, 13D, and 13F illustrate examples using planar backup mechanisms.
Figure 13C:
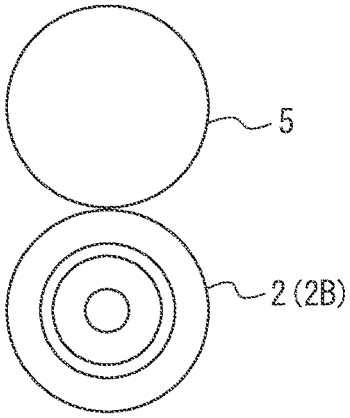
FIGS. 13C, 13E, and 13G illustrate examples using roll-shaped backup mechanisms.
Figure 13D:
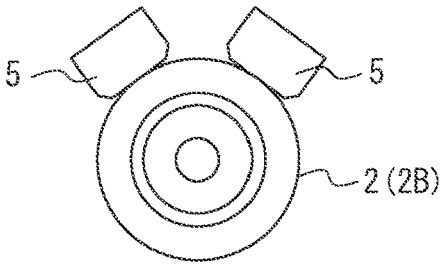
Figure 13E:
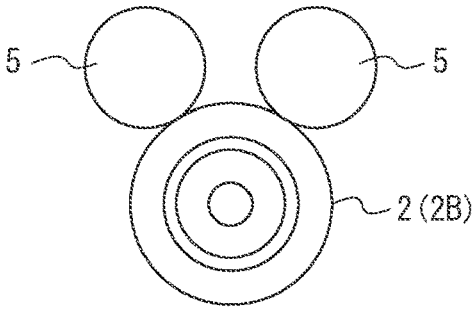
Figure 13F:
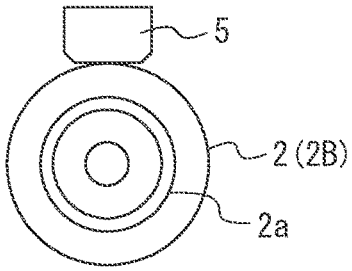
Figure 13G:
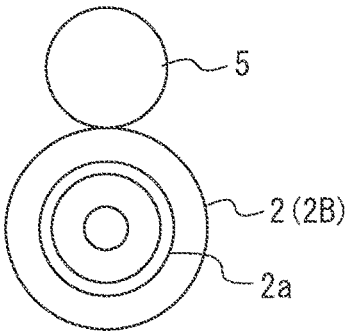

As in FIG. 7, when setting all the rolling rolls 2 as drive rolls, each rolling roll 2 is driven in such a manner as to match the peripheral speed of the each rolling roll 2 with the peripheral speed of the material to be rolled 1. On the other hand, when the torque of the maximum diameter rolling roll 2A is sufficiently large to perform rolling, driving only the at least one rolling roll 2 enables further suppression of axial bending. Furthermore, reducing the number of the drive rolls makes it unnecessary to provide a drive shaft for power transmission and rotation, so that equipment cost can be reduced and space saving can be achieved.

Furthermore, as in FIG. 7, in the case where all the rolling rolls 2 are drive rolls, when the diameter of the steel pipe 1 is made small, the drive shafts 3 easily interfere with the pass line P depending on a magnitude of the crossing angle β, narrowing the freedom of equipment.

<Backup Mechanism 5>

For the at least one rolling roll 2 selected from the at least one small diameter rolling roll 2B, it is preferable to provide a backup mechanism 5 that receives load applied to the at least one rolling roll 2, as illustrated in FIGS. 8 to 13. Note that, in FIG. 13, reference sign 2*b* denotes a shaft portion of the rolling roll 2, and reference sign 2*a* denotes a connection portion for connecting the shaft portion to a roll main body.

In the rolling mill of the present embodiment, the at least one rolling roll 2 selected from the three or more rolling rolls 2 is the small diameter rolling roll 2B whose roll diameter is equal to or less than 90% of the roll diameter of the at least one other rolling roll 2. Therefore, as compared to the case where the roll diameters of all the rolling rolls 2 are made small, rigidity of the entire rolling mill is improved, so that large torque can be transmitted to the maximum outer diameter rolling roll 2 as well as excellent dimensional accuracy is achieved.

On the other hand, it is an effective means to provide the backup mechanism 5 that receives load on the small diameter rolling roll 2B, from the viewpoint of further suppression of deflection of the small diameter rolling roll 2B due to the load applied to the small diameter rolling roll 2B having a roll diameter of 90% or less to improve the outer diameter dimensional accuracy.

The backup mechanism 5 can be of any form that supports rolling reaction force of the rolling roll 2. As the backup mechanism 5, one or more backup mechanisms 5 may be arranged near an opposite side of a rolling surface of the rolling roll 2 or at the axial portion of the rolling roll 2. Additionally, the backup mechanism 5 may be formed by a roll, as in FIG. 8 or the like, or may be of a form that supports the roll or the axial portion on a surface thereof while sliding, as in FIG. 9 or the like.

As described above, even when a strip material made of a pipe or bar material is made small in diameter, using the skew rolling mill for diameter reducing rolling according to the present embodiment improves outer diameter dimensional accuracy after rolling over the entire length of the strip material. In other words, a pipe or bar material with excellent outer diameter dimensional accuracy can be manufactured.

(1) The rolling mill for diameter reducing rolling according to the present embodiment includes three or more rolling rolls aligned along a circumferential direction of a material to be rolled made of a pipe or bar material, and arranged such that each rotary shaft of the rolling rolls is skewed with respect to a pass line of the material to be rolled, at least one rolling roll selected from the three or more rolling rolls being configured as a drive roll that is rotationally driven, and the material to be rolled being caused to pass through between the three or more rolling rolls while being rotated to undergo the diameter reducing rolling, in which at least one rolling roll selected from the three or more rolling rolls is smaller in roll diameter than at least one other rolling roll, and when, among the three or more rolling rolls, at least one rolling roll having a maximum roll diameter is defined as a maximum diameter rolling roll and at least one rolling roll smaller in roll diameter than the maximum diameter rolling roll is defined as a small diameter rolling roll, the small diameter rolling roll has a roll diameter equal to or less than 90% of the roll diameter of the maximum diameter rolling roll.

With this structure, even when the strip material made of a pipe or bar material is made small in diameter, outer diameter dimensional accuracy after rolling improves over the entire length of the strip material, so that a significant effect of improving product quality can be obtained. In other words, a pipe or bar material excellent in outer diameter dimensional accuracy can be manufactured.

(2) In the present embodiment, at least one rolling roll selected from the maximum diameter rolling roll is the drive roll, and at least one rolling roll selected from the small diameter rolling roll is a non-drive rolling roll.

With this structure, while it is possible to accommodate a small diameter material to be rolled by using at least one of the rolling rolls as a small diameter rolling roll, bending of the small diameter rolling roll is suppressed, whereby excellent outer diameter dimensional accuracy can be obtained.

(3) In the present embodiment, a backup mechanism is provided to receive a load that is applied to the at least one rolling roll selected from the small diameter rolling roll.

With this structure, bending of the small diameter rolling roll is further suppressed, so that excellent outer diameter dimensional accuracy can be obtained.

(4) In the present embodiment, roll rotary shafts of the three or more rolling rolls are arranged at an angle of ((360 degrees/the number of rolls) ±20 degrees) along a circumferential direction of the pass line.

With this structure, even when at least one of the rolling rolls is the small diameter rolling roll, complexity of a housing shape can be suppressed.

In this case, the three or more rolling rolls may be configured such that arrangement angle intervals between the rotary shafts of the rolling rolls arranged along in the circumferential direction of the pass line are different.

Additionally, for example, a configuration is adopted such that the three or more rolling rolls are arranged asymmetrically along the circumferential direction of the pass line.

With this structure, even when at least one of the rolling rolls is the small diameter rolling roll, interference between the rolling rolls can be reduced.

(5) A method for manufacturing a strip material according to the present embodiment includes rolling a material to be rolled made of a pipe or bar material by using the rolling mill for diameter reducing rolling described above to reduce an outer diameter of the material to be rolled.

With this structure, a pipe or bar material with excellent outer diameter dimensional accuracy can be manufactured.

EXAMPLES

Diameter reducing rolling was performed using the skew rolling mill according to the present invention. The present Example used, as materials to be rolled, steel bars and steel pipes having an outer diameter of 100 mm or 90 mm and a length of 10 m. Additionally, the rolling was performed by setting desired outer diameters after rolling to 90 mm and 80 mm, respectively. In the following Table 1, the materials to be rolled of Nos. 4, 17, and 19 had the small diameter of 90 mm as an outer diameter before the rolling. The other materials to be rolled (Nos. 1 to 3, 5 to 16, 18, and 20) had the large diameter of 100 mm as an outer diameter before the rolling.

Here, as chemical compositions of the steel bars and the steel pipes, those predetermined in JIS were used. As the steel bars, JIS S15C (carbon steel: 0.15% C steel) was used. As the steel pipes, JIS SUS329J4L (25% Cr stainless steel containing an austenite phase of 50%) was used. Note that the present invention is not particularly limited as long as it is a material plastically deformed in cold rolling, as typified by a metal material.

For evaluation, axial outer diameter tolerance after the rolling was measured. The outer diameter tolerance was obtained by measuring a maximum outer diameter portion and a minimum outer diameter portion, respectively, of the material to be rolled at a pitch of 100 mm in a longitudinal direction from a tip thereof and measuring in percentages (%) differences (errors) between the maximum and minimum measured values and a targeted outer diameter value. In addition, axial bending was also evaluated by an amount of bending per meter.

The number of rolling rolls was three or four, and a barrel shape was adopted as the shape of the rolls.

In Comparative Examples, when the roll diameters were all the same, the roll diameter was 650 mm in the case of three rolls, and 250 mm in the case of four rolls. Note that the roll diameters in the above Comparative Examples were limit values at which no interference between the rolling rolls occurred.

In the above conditions, comparison was made regarding the number of rolls, the roll diameter of the maximum diameter rolling roll 2A, the roll diameter and number of the small diameter rolling rolls 2B, whether the small diameter rolling roll (s) 2B is/are driven or non-driven, and also, the presence or absence of the backup mechanism 5 to evaluate dimensional errors and bending after the rolling. The backup mechanism was a type of mechanism contacting with the roll or the rotary shaft while sliding on a rolling surface back side of the roll. Additionally, the backup mechanism 5 was provided only for the small diameter rolling roll(s) 2B.

Table 1 shows the conditions and evaluation results.

TABLE 1

| No. | Material to be rolled: bar or pipe | Number of rolling rolls (pieces) | Roll diameter of maximum diameter rolling roll (mm) | Number of small diameter rolling rolls | Roll diameter of small diameter rolling roll (mm) | Roll diameter ratio | Small diameter rolling roll driven/non-driven |
|---|---|---|---|---|---|---|---|
| 1 | Pipe | 3 | 650 | 0 | — | 100 | Driven |
| 2 | Bar | 4 | 250 | 0 | — | 100 | Driven |
| 3 | Bar | 3 | 750 | 1 | 500 | 67 | Driven |
| 4 | Pipe | 3 | 750 | 2 | 430 | 57 | Non-driven |
| 5 | Pipe | 3 | 750 | 2 | 430 | 57 | Non-driven |
| 6 | Pipe | 3 | 750 | 2 | 600 | 80 | Driven |
| 7 | Bar | 4 | 350 | 2 | 180 | 51 | Driven |
| 8 | Pipe | 4 | 280 | 3 | 230 | 82 | Driven |
| 9 | Pipe | 3 | 750 | 2 | 600 | 80 | Non-driven |
| 10 | Pipe | 3 | 750 | 2 | 600 | 80 | Driven |

TABLE 1-continued

| | | | | | | | |
|---|---|---|---|---|---|---|---|
| 11 | Pipe | 3 | 750 | 2 | 600 | 80 | Non-driven |
| 12 | Pipe | 3 | 700 | 2 | 620 | 89 | Driven |
| 13 | Pipe | 3 | 850 | 2 | 350 | 41 | Driven |
| 14 | Pipe | 3 | 850 | 2 | 350 | 41 | Non-driven |
| 15 | Pipe | 3 | 660 | 2 | 600 | 91 | Driven |
| 16 | Pipe | 3 | 850 | 2 | 300 | 35 | Non-driven |
| 17 | Pipe | 3 | 850 | 2 | 300 | 35 | Non-driven |
| 18 | Bar | 4 | 350 | 2 | 170 | 49 | Driven |
| 19 | Bar | 4 | 360 | 3 | 150 | 42 | Non-driven |
| 20 | Bar | 4 | 360 | 3 | 150 | 42 | Non-driven |

| No. | Backup mechanism present/ absent | Dimensional tolerance minimum portion to maximum portion (%) | Difference (%) | Evaluation | Bending mm/m | Comparative/ Invention |
|---|---|---|---|---|---|---|
| 1 | Absent | −1.05 to 1.89 | 2.94 | X | 1.5 | Comparative example |
| 2 | Absent | −1.08 to 3.85 | 4.93 | X | 2.2 | Comparative example |
| 3 | Absent | −0.56 to 0.95 | 1.51 | ○ | 1.4 | Invention example |
| 4 | Present | −0.35 to 0.25 | 0.60 | ◎ | 1.6 | Invention example |
| 5 | Present | −0.25 to 0.36 | 0.61 | ◎ | 1.5 | Invention example |
| 6 | Absent | −0.46 to 0.44 | 0.90 | ◎ | 1.4 | Invention example |
| 7 | Absent | −0.85 to 1.12 | 1.97 | ○ | 1.8 | Invention example |
| 8 | Absent | −0.77 to 0.89 | 1.66 | ○ | 1.7 | Invention example |
| 9 | Absent | −0.44 to 0.38 | 0.82 | ◎ | 0.4 | Invention example |
| 10 | Present | −0.28 to 0.21 | 0.49 | ◎ | 1.2 | Invention example |
| 11 | Present | −0.27 to 0.18 | 0.45 | ◎ | 0.3 | Invention example |
| 12 | Absent | −0.45 to 0.45 | 0.90 | ◎ | 1.4 | Invention example |
| 13 | Present | −0.33 to 0.31 | 0.64 | ◎ | 1.2 | Invention example |
| 14 | Present | −0.32 to 0.29 | 0.61 | ◎ | 0.4 | Invention example |
| 15 | Absent | −1.04 to 1.88 | 2.92 | X | 1.5 | Comparative example |
| 16 | Absent | −0.98 to 0.99 | 1.97 | ○ | 2.2 | Invention example |
| 17 | Absent | −0.99 to 1.85 | 1.84 | ○ | 1.6 | Invention example |
| 18 | Absent | −0.86 to 1.13 | 1.99 | ○ | 1.9 | Invention example |
| 19 | Present | 0.05 to 0.85 | 0.80 | ◎ | 0.8 | Invention example |
| 20 | Present | −0.33 to 0.45 | 0.78 | ◎ | 0.7 | Invention example |

Good or bad judgement after the rolling was made based on a difference in the measured minimum and maximum outer diameter errors, and evaluation was made as follows:

◎: Difference in outer diameter errors was from 0% to less than 1%

○: Difference in outer diameter errors was from 1% to less than 2% x: Difference in outer diameter errors was 2% or more

As shown in Table 1, while Comparative Examples had dimensional accuracies in which the differences in the outer diameter errors exceeded 2%, Invention Examples suppressed the differences in the outer diameter errors to less than 2%. Thus, it has been shown that performing diameter reducing rolling using the rolling mill according to the present invention enables manufacturing of a steel bar and a steel pipe excellent in outer diameter accuracy and quality.

Additionally, Invention Examples confirmed that bending was improved even under the condition that the small diameter rolling rolls 2B were non-driven. Furthermore, in this case, providing the backup mechanism 5 was confirmed to further improve dimensional accuracy.

In addition, regarding the steel pipe, all Invention Examples confirmed that excellent mechanical characteristics were exhibited, in which the tensile yield strength in the pipe axis direction was 757.9 MPa or more, and (compressive yield strength in pipe axis direction/tensile yield strength in pipe axis direction) were from 0.90 to 1.15.

Additionally, the present application claims priority to Japanese Patent Application No. 2019-211784 (filed on Nov. 22, 2019), the entire content of which is incorporated by reference as a part of the present disclosure. Herein, while the present invention has been described with reference to the limited number of embodiments, the scope of the invention is not limited thereto. Modifications and alterations to the respective embodiments based on the above disclosure will be apparent to those skilled in the art.

REFERENCE SIGNS LIST

1: Material to be rolled (steel pipe)
2: Rolling roll
2A: Maximum diameter rolling roll
2B: Small diameter rolling roll
3: Drive shaft
5: Backup mechanism
P: Pass line

The invention claimed is:

1. A rolling mill for diameter reducing rolling comprising:

three or more rolling rolls aligned along a circumferential direction of a material to be rolled made of a pipe or bar material, and arranged such that each rotary shaft of the rolling rolls is skewed with respect to a pass line of the material to be rolled, at least one rolling roll from among the three or more rolling rolls being configured as a drive roll that is rotationally driven, and wherein the three or more rolling rolls are configured to pass the material to be rolled through between the three or more rolling rolls while rotating the material to undergo the diameter reducing rolling, wherein at least one rolling roll from among the three or more rolling rolls is smaller in roll diameter than at least one other rolling roll; and wherein, among the three or more rolling rolls, at least one rolling roll having a maximum roll diameter is defined as a maximum diameter rolling roll and at least one rolling roll smaller in diameter than the maximum diameter rolling roll is defined as a small diameter rolling roll, and the small diameter rolling roll has a roll diameter greater than or equal to 65% and equal to or less than 85% of the roll diameter of the maximum diameter rolling roll.

2. The rolling mill for diameter reducing rolling according to claim 1, wherein at least one rolling roll from among the maximum diameter rolling roll is the drive roll, and at least one rolling roll from among the small diameter rolling roll is a non-drive rolling roll.

3. The rolling mill for diameter reducing rolling according to claim 1, wherein a backup mechanism is provided to receive a load that is applied to the at least one rolling roll from among the small diameter rolling roll.

4. The rolling mill for diameter reducing rolling according to claim 1, wherein roll rotary shafts of the three or more rolling rolls are arranged at an angle of 360 degrees/the number of rolls ±20 degrees along a circumferential direction of the pass line.

5. The rolling mill for diameter reducing rolling according to claim 4, wherein in the three or more rolling rolls, arrangement angle intervals between the rotary shafts of the rolling rolls arranged along the circumferential direction of the pass line are different.

6. The rolling mill for diameter reducing rolling according to claim 1, wherein the three or more rolling rolls are arranged asymmetrically along the circumferential direction of the pass line.

7. A method for manufacturing a strip material comprising operating the rolling mill for diameter reducing rolling according to claim 1 so as to roll the pipe or bar material and reduce an outer diameter of the pipe or bar material.

8. The rolling mill for diameter reducing rolling according to claim 2, wherein a backup mechanism is provided to receive a load that is applied to the at least one rolling roll from among the small diameter rolling roll.

9. The rolling mill for diameter reducing rolling according to claim 2, wherein roll rotary shafts of the three or more rolling rolls are arranged at ((an angle of 360 degrees/the number of rolls)±20 degrees) along a circumferential direction of the pass line.

10. The rolling mill for diameter reducing rolling according to claim 3, wherein roll rotary shafts of the three or more rolling rolls are arranged at an angle of 360 degrees/the number of rolls ±20 degrees along a circumferential direction of the pass line.

11. The rolling mill for diameter reducing rolling according to claim 2, wherein the three or more rolling rolls are arranged asymmetrically along the circumferential direction of the pass line.

12. The rolling mill for diameter reducing rolling according to claim 3, wherein the three or more rolling rolls are arranged asymmetrically along the circumferential direction of the pass line.

13. The rolling mill for diameter reducing rolling according to claim 4, wherein the three or more rolling rolls are arranged asymmetrically along the circumferential direction of the pass line.

14. The rolling mill for diameter reducing rolling according to claim 5, wherein the three or more rolling rolls are arranged asymmetrically along the circumferential direction of the pass line.

15. A method for manufacturing a strip material comprising operating the rolling mill for diameter reducing rolling according to claim 2 so as to roll the pipe or bar material and reduce an outer diameter of the pipe or bar material.

16. A method for manufacturing a strip material comprising operating the rolling mill for diameter reducing rolling according to claim 3 so as to roll the pipe or bar material and reduce an outer diameter of the pipe or bar material.

17. A method for manufacturing a strip material comprising operating the rolling mill for diameter reducing rolling according to claim 4 so as to roll the pipe or bar material and reduce an outer diameter of the pipe or bar material.

18. A method for manufacturing a strip material comprising operating the rolling mill for diameter reducing rolling according to claim 5 so as to roll the pipe or bar material and reduce an outer diameter of the pipe or bar material.

19. A method for manufacturing a strip material comprising operating the rolling mill for diameter reducing rolling according to claim 6 so as to roll the pipe or bar material and reduce an outer diameter of the pipe or bar material.

20. The rolling mill for diameter reducing rolling according to claim 1, wherein (i) only three rolling rolls are included, and (ii) two of the rolling rolls are small diameter rolls smaller in diameter than the third rolling roll of the three rolling rolls.

* * * * *